United States Patent [19]

Tyree et al.

[11] 4,409,443

[45] Oct. 11, 1983

[54] PRESSURE RESPONSIVE ELECTRICAL SWITCHING APPARATUS

[75] Inventors: Charles N. Tyree; Lester L. Fike, Jr.; Ronald A. McIntire, all of Blue Springs, Mo.

[73] Assignee: Fike Metal Products Corporation, Blue Springs, Mo.

[21] Appl. No.: 270,220

[22] Filed: Jun. 4, 1981

[51] Int. Cl.[3] ..... H01H 35/34

[52] U.S. Cl. ..... 200/83 N; 73/717; 73/723

[58] Field of Search ..... 307/118; 340/605, 611, 340/626; 73/715, 717, 723; 200/61.08, 81 R, 83 R, 83 N, 83 W, 302, 303, 306, 159 B

[56] References Cited

U.S. PATENT DOCUMENTS

| | | | |
|---|---|---|---|
| 2,253,425 | 8/1941 | Garland | 200/82 R |
| 3,267,233 | 8/1966 | Basile | 200/83 N |
| 3,300,703 | 1/1967 | Gold | 320/46 |
| 3,860,772 | 1/1975 | Byrd | 200/83 N |

FOREIGN PATENT DOCUMENTS

| | | | |
|---|---|---|---|
| 2408621 | 9/1974 | Fed. Rep. of Germany | 200/83 N |
| 1013778 | 8/1952 | France | 200/83 N |

*Primary Examiner*—G. P. Tolin

*Attorney, Agent, or Firm*—Schmidt, Johnson, Hovey & Williams

[57] ABSTRACT

An improved construction is provided for fluid pressure responsive electrical switching apparatus, which achieves physical miniaturization, quick response time, sensitivity to relatively low levels of change or differential in fluid pressures, adaptability for employment in corrosive environments and under a very wide range of temperature conditions, simplicity and economy of fabrication and assembly, reliability of operation and general versatility for utilization in diverse applications. The improved apparatus involves, besides suitable housing structure that may provide for installation accommodating to various pressure and other conditions dictated by the application, a thin, wafer-like laminated switch assembly peripherally sealed in the housing structure and disposed for direct fluid communication with the fluid whose pressure is to be monitored for the purpose of controlling actuation of the switch assembly.

6 Claims, 8 Drawing Figures

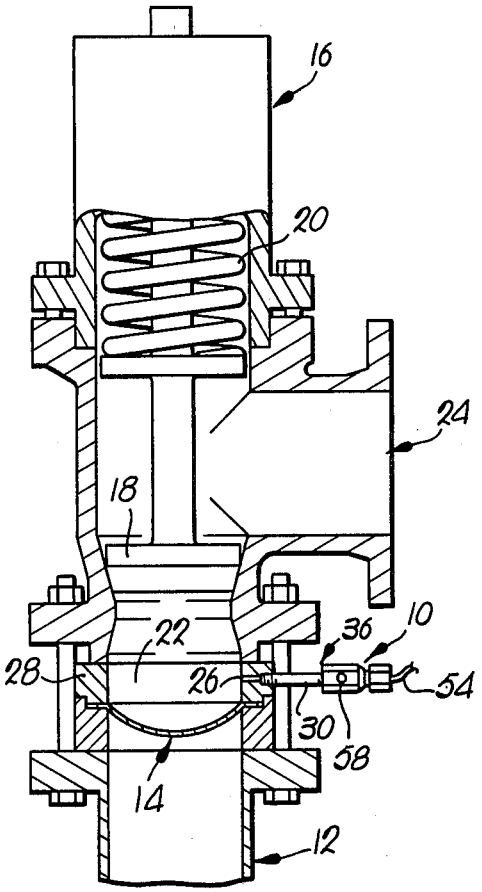
Fig. 1.
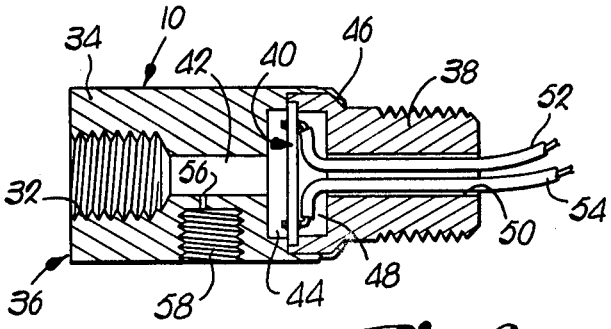
Fig. 2.
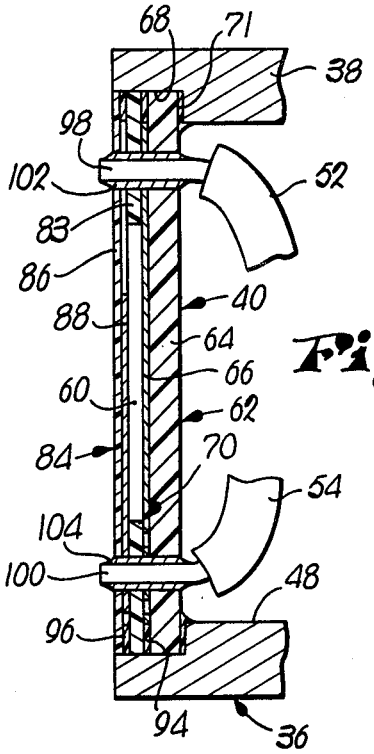
Fig. 4.
Fig. 3.
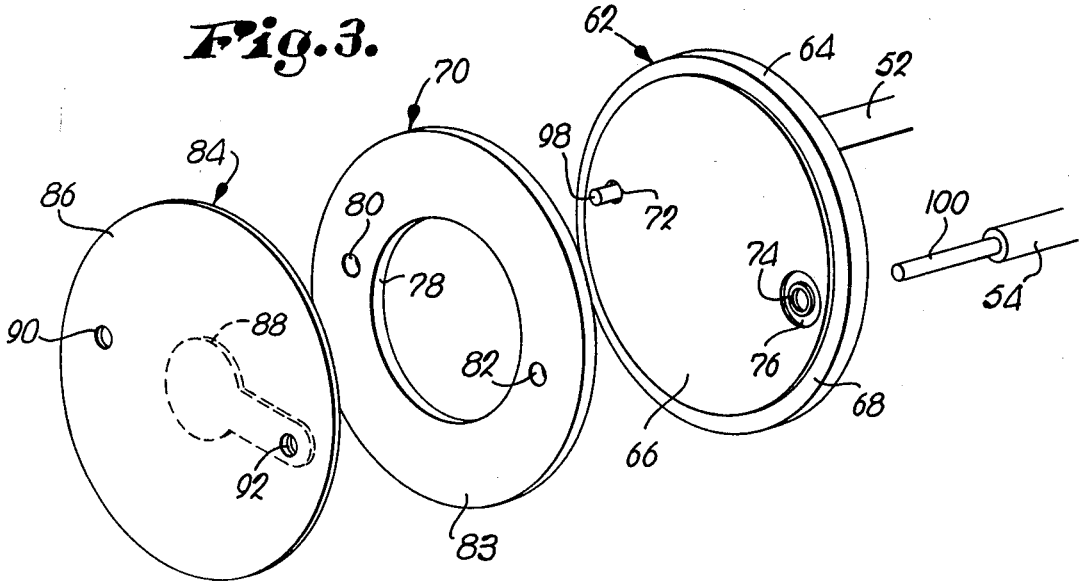

Fig. 5.
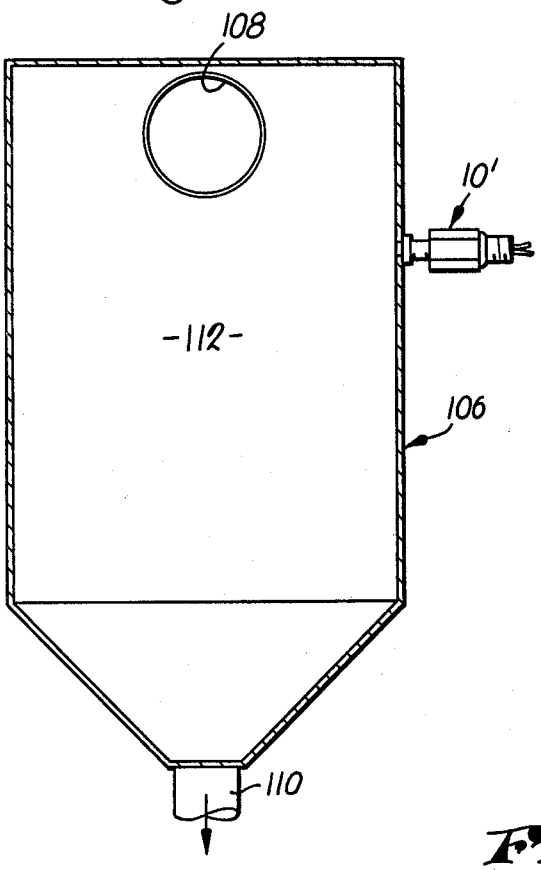
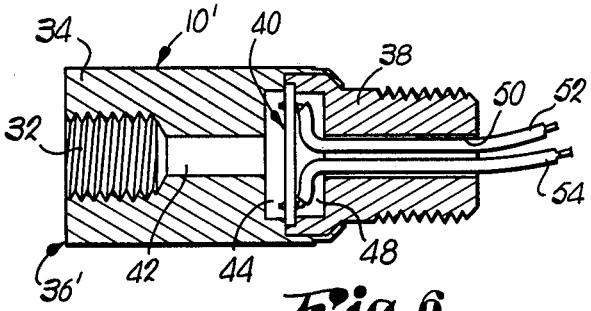
Fig. 6.
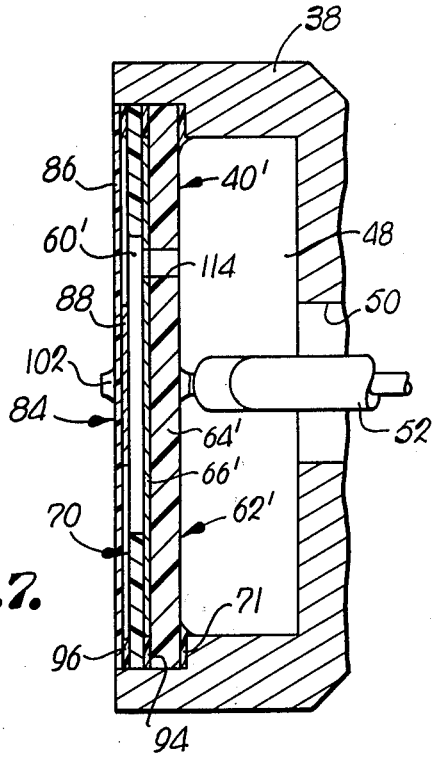
Fig. 7.
Fig. 8.
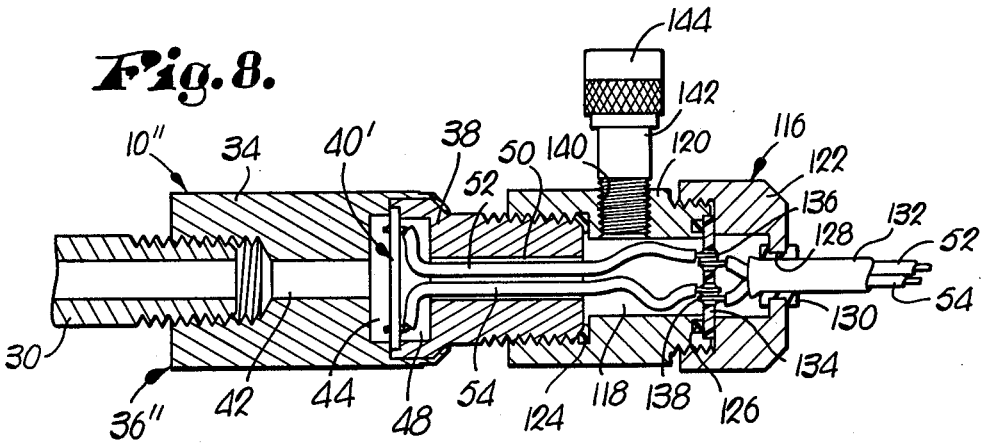

PRESSURE RESPONSIVE ELECTRICAL SWITCHING APPARATUS

BACKGROUND OF THE INVENTION

1. Field of the Invention

This invention relates to electrical switching apparatus and, more particularly, to that class of such apparatus which is actuatable automatically in response to fluid pressures or pressure differentials applied thereto.

Still more specifically, this invention is concerned with providing an improved organization and constructions for such apparatus to enhance the performance and versatility of application thereof, while also reducing the size, cost and complexity thereof.

2. Description of the Prior Art

In the most general sense, the essential primary elements of, say, a normally open, single pole, electrical switch are well known and would include a pair of electrically conductive contacts, some means typically of electrically insulative material for supporting the contacts in normally spaced relationship to each other, and some means for permitting and causing at least one of the contacts to move into engagement with the other for effecting an electrical connection therewith. It is also known that the contacts themselves may be rigid with the supporting means therefor permitting one to be moved toward the other or at least one of the contacts may be formed of resilient material permitting it to be temporarily deformed so that a portion of same will engage the other contact; that the means for supporting the contacts may be either yieldable or rigid to cooperate with the nature of the contacts; that auxiliary mechanisms such as springs may be employed to bias one or both of the contacts toward their normal separated juxtaposition; and that various means may be utilized for actuating one contact into engagement with the other, including by the application of manual force to one or both contacts (typically through some yieldable, electrically insulative cover or handle to electrically isolate the person applying such force from the contacts themselves), by the application of machine generated mechanical forces to one or both contacts (typically through some appropriate auxiliary linkage or interengagement of parts), by the application of magnetic forces (typically through some form of armature associated with one of the contacts), or by the application of fluid pressure produced forces (typically through movement of a diaphragm or piston mechanically linked or shiftable into interengagement with one of the contacts).

Within such framework of known fundamentals, a great diversity of electrical switching devices have been proposed or constructed having widely differing constructional and operational characteristics and intended for utilization in a variety of applications and environments, although none are known that achieve the significant combination of advantages provided by the improved organization and constructions of the present invention.

Although probably not directly relevant to the present invention, the general state of the prior art respecting electrical switching devices intended and adapted for use in applications in which actuation of the switch is responsive to a manually applied pressing or squeezing force, either directly or through some intermediate instrumentality such as driving a vehicle over a treadle, are illustrated by the following U.S. Patents: Armstrong U.S. Pat. No. 2,244,933, Schwinn U.S. Pat. No. 2,367,441, Burke U.S. Pat. No. 2,583,813, Schulenburg U.S. Pat. No. 2,823,279, Cooper U.S. Pat. No. 2,909,628, Hohmann U.S. Pat. No. 2,959,647, Mahoney U.S. Pat. No. 2,975,350, and Weissburg U.S. Pat. No. 3,209,089. Similarly, the state of the prior art respecting electrical switching devices that are responsive to fluid pressure, but wherein a diaphragm or other element that is shifted in response to fluid pressure is opposed by some mechanical biasing means such as a spring or by magnetic means is illustrated by the following U.S. Patents: Muerle U.S. Pat. No. 2,412,095, Kennelly U.S. Pat. No. 2,439,474, McGee U.S. Pat. No. 3,038,044, Gold U.S. Pat. No. 3,300,703 and Kolze U.S. Pat. No. 3,366,760. Another approach to accomplishing an electrical switching function in response to an extreme fluid pressure condition sufficient to destroy a rupture disc or the like and thereby mechanically free a biasing element to permit or cause switch closure is illustrated by the Lewis U.S. Pat. No. 2,230,961.

Of greater specific interest as background for the present invention, however, would seem to be the state of the prior art with respect to electrical switching devices that respond more directly to a fluid pressure differential, which is illustrated in terms of differentials between positive fluid pressure levels, differentials between a positive fluid pressure level and a vacuum, etc., by the following U.S. Patents: Bast U.S. Pat. No. 1,684,530, Lupold et al. U.S. Pat. No. 1,974,779, Wesley et al. U.S. Pat. No. 2,251,180, Garland U.S. Pat. No. 2,253,425, Hard af Segerstad U.S. Pat. No. 2,421,149, Gill U.S. Pat. No. 2,505,539, Winter U.S. Pat. No. 2,561,962, Edwards, Jr., et al. U.S. Pat. No. 2,919,320, Lindberg, Jr., U.S. Pat. No. 3,180,956 and Basile et al. U.S. Pat. No. 3,267,233. Although the construction and arrangement of parts involved in the devices of the last mentioned group of prior patentees are diverse and the disclosures of such patents reveal various intended specific applications for such devices, it is believed fair to observe both that such patents seem to indicate a general trend toward increasing complexity with time and constructional approaches characterized by relatively large size and attendant costs of initial manufacture and replacement. Moreover, none of such prior devices found to have been disclosed in the apparently more pertinent area of the prior art appear well suited for versatile utilization in diverse applications, including those reqiring satisfaction of a combination of stringent operating characteristics such as physical miniaturization, quick response time, sensitivity to relatively low levels of change in fluid pressures, or reliable operation in adverse environments involving corrosive fluids or unusually high or low temperatures.

It is believed, therefore, that the previously existing state of the prior art relating to fluid pressure responsive electrical switching apparatus has left unfulfilled a long standing and important need for improvements in the organization and construction of the noted class of devices to overcome the mentioned disadvantages and limitations of what has heretofore been available.

SUMMARY OF THE INVENTION

The improved pressure responsive electrical switching apparatus provided by this invention overcomes the previously noted disadvantages and limitations of all known prior devices of such class, and does so in a manner utilizing structural reorganization and simplification to achieve not only enhanced performance and versatility, but also reduced costs of fabrication and assembly.

The improved apparatus provided by the invention employs a thin, wafer-like, laminated switch assembly peripherally sealed in a housing structure and having a relatively yieldable, electrically insulative end wall serving as a pressure sensitive diaphragm in direct fluid communication with the zone of fluid pressure to be monitored, an electrically conductive contact secured to the inner side of the diaphragm for inward movement with the latter in response to external fluid pressure, a relatively rigid, electrically insulative, opposite baseplate, an electrically conductive, fixed contact secured to the inner side of the baseplate, a centrally apertured spacer between the diaphragm and the baseplate to provide clearance for fluid pressure responsive engagement between the normally separated contacts when the contact on the diaphragm is shifted toward the baseplate and to present an internal chamber in fluid communication with the diaphragm for subjecting the inner side of the latter to a reference level pressure, either from fluid confined within such chamber or from an external zone with which the chamber may communicate through an opening that may be provided in the baseplate and its associated contact for that purpose, and electrical leads respectively connected with the contacts internally of the assembly and emanating from the latter through the baseplate end thereof.

The switch assembly itself is mounted and peripherally sealed within a suitable housing structure that communicates the outer face of the diaphragm directly with the zone to whose fluid pressure the switch assembly is to respond, and such housing structure may be provided with auxiliary means for accommodating to special requirements, such as long term adjustment to changes in ambient atmospheric pressure of the particular environment in which the apparatus is to operate.

A further significant feature of the improved switching apparatus construction provided by the invention is the manner in which it permits electrical leads to be connected to the switch contacts internally of the sealed switch assembly and to emanate from the baseplate extremity of the latter way from both the corrosive environment that may be present at the diaphragm extremity of the assembly and metal housing parts that typically will be present adjacent the periphery of the switch assembly for supporting the latter.

A typical, currently preferred embodiment of the switch assembly portion of the apparatus is less than 1.0 inch in diameter, is less than 0.1 inch in thickness, is adapted to respond to fluid pressure differentials of a selected level between about 15.0 psig or more and 1.0 psig or less, is adapted to actuate within a few milliseconds of the commencement of the actuating pressure condition for which it is designed, is adapted for utilization in environments involving highly corrosive fluids, and is adapted to operate under temperature conditions ranging from far below normal freezing or refrigerating temperatures to far above the boiling temperatures of typical liquids.

BRIEF DESCRIPTION OF THE DRAWINGS

In the accompanying drawings:

FIG. 1 is a view, largely in cross-section but with some parts illustrated in elevation, showing a general arrangement for utilizing one form of the improved pressure responsive electrical switching apparatus provided by this invention in an application of the latter for sensing significant leakage of fluid through or around a rupture disc in a typical high pressure rupture disc installation;

FIG. 2 is a view, largely in cross-section but with some parts illustrated in elevation, showing the currently preferred form of housing structure for use in the application of FIG. 1 for supporting the pressure responsive switch assembly provided by the invention in operative relationship with the other parts of the installation;

FIG. 3 is an exploded, perspective view showing the primary parts of the currently preferred form of switch assembly provided by the invention, prior to final assembly thereof;

FIG. 4 is a view, largely in cross-section but with some parts illustrated in elevation, showing the form of switch assembly depicted in FIG. 3 in assembled condition and implaced within a portion of the housing structure depicted in FIG. 2;

FIG. 6 is a view, largely in cross-section but with some parts illustrated in elevation, and similar to FIG. 2, except showing a different form of housing structure employed with the switch assembly of FIG. 4 in certain applications of the apparatus, including the one depicted in FIG. 5;

FIG. 7 is a view, largely in cross-section but with some parts illustrated in elevation, showing a modified form of the switch assembly contemplated by the invention, in which the internal chamber of the assembly is placed in fluid communication with a zone outside the baseplate of the assembly through an opening in the latter, which form of switch assembly may be employed in differing applications within a housing structure of any of the types depicted in FIGS, 2, 6 or 8; and FIG. 8 is a view, largely in cross-section but with some parts illustrated in elevation, showing a further modified form of the housing structure depicted in FIG. 6, which is provided with means presenting an enclosure for fluid at a reference pressure level for use especially in conjunction with the modified form of switch assembly depicted in FIG. 7.

DESCRIPTION OF THE PREFERRED EMBODIMENTS

As previously observed, the apparatus provided by this invention is very versatile and can be employed or readily adapted for employment in a wide range of diverse applications. Depending upon possible special requirements of particular applications, some minor variation in certain details of the construction may be appropriate. Since it appears impractical to attempt to describe or even anticipate all of the possible applications for the apparatus, the principles of the invention have been illustrated in the drawings and will be explained herein with reference to two illustrative applications, two preferred variants of the switch assembly part of the apparatus, and three preferred variants of the housing structure part of the apparatus.

Referring initially to FIG. 1, there is illustrated an application of the pressure responsive, electrical switching apparatus 10 of the invention in conjunction with a typical rupture disc installation of the type commonly employed for normally isolating high pressure fluid lines from pressure relief valves. The conventional part of such an installation includes an inlet pipe 12 tapped into a high pressure fluid line (not shown), a rupture disc assembly 14 normally blocking the pipe 12, and a pressure relief valve assembly 16 including a valve member 18 normally biased by a spring 20 into a seated position as illustrated for closing a fluid path between the zone 22 downstream of the rupture disc assembly 14 and a main relief outlet or vent 24 typically communicating with the atmosphere. In such installations, the rupture disc assembly 14 normally protects the valve member 18 against continuous contact with the often corrosive fluid being handled by the system and, as long as the rupture disc assembly 14 remains intact and in condition closing the inlet pipe 12 away from the zone 22, pressure relief valve member 18 and vent outlet 24, such pressure relief installations remain essentially passive elements of high pressure fluid systems provided for safety purposes. In the event of an excessively high pressure condition arising within the portion of the fluid system to which the inlet pipe 12 is connected, however, then the rupture disc assembly 14 will break, thereby communicating the fluid pressure from the pipe 12 with the valve member 18, to open the latter against the influence of the spring 20 in sufficient amount and for a sufficient time to relieve the excess pressure condition by venting the involved fluid to the atmosphere or another conduit path (not shown) through the outlet 24. It is noted that, in such installations, it is usually desirable to maintain the zone 22 downstream from the rupture disc assembly 14 at or near atmospheric pressure, in order that the rupture disc assembly 14 will consistently perform accordingly to design specifications, rather than having the parameters of its rupturing characteristics altered by the possible buildup of a back pressure within the zone 22 between the rupture disc assembly 14 and the relief valve member 18, so that it is common to provide a small bleed port (not shown) from the zone 22 to the atmosphere for the purpose of dissipating any pressure buildup within the zone 22 which might otherwise result from slow leakage of fluid through or around the rupture disc assembly 14 over a period of time.

It is, however, seemingly an inherent aspect of installations employing rupture disc assemblies in high pressure environments, and especially where the pressurized fluid being restrained by the rupture disc assembly may be of a corrosive nature, that some such rupture disc assemblies will in time develop slow leaks permitting the incremental passage of fluid under pressure therethrough or therearound into the zone 22 downstream from the involved rupture disc assembly 14. Moreover, such leaks tend with the passage of time to increase in size and to permit an increasing amount of fluid to escape into the zone 22, which results in a gradual weakening of the rupture disc assembly 14, impairment of its ability to perform its intended function, and oftentimes subsequent rupture of the disc assembly 14. Another problem with conventional rupture disc and pressure relief valve installations in high pressure systems is that unexpected rupturing of the rupture disc assembly 14 and opening of the pressure relief valve 16 may result in either overt disruption of an ongoing industrial process or system or the discharge of significant quantities of the fluid being handled from the outlet 24 or both, with resultant loss or danger or both. Accordingly, since the development of slow leaks in association with rupture disc assemblies 14 seems to be essentially inevitable, at least in many environments of application for such devices, it would be highly desirable to be able to recognize the existence and growth of such leaks at an early stage, in order that the associated system may be shut down in an orderly fashion or otherwise regulated to permit displacement of the defective rupture valve assembly 14 before the situation has degenerated to a condition making rupturing of the disc assembly 14 and the pressure relief discharge of the fluid being handled imminent. FIG. 1 illustrates an application of the improved pressure sensitive, electrical switching apparatus of the invention for that purpose.

Referring to FIG. 2 along with FIG. 1, the switching apparatus 10 is communicated with the zone 22 downstream of the rupture disc assembly 14 via a passage 26 in a sleeve 28 and a stub pipe 30 connected with an inlet 32 in a body member 34 of a housing structure generally designated 36 and having a second body member 38. The improved electrical switch assembly provided by the invention is generally designated 40 and is mounted within the housing 36 between the body members 34 and 38 of the latter in manner accomplishing a fluid seal around the outermost margin of the switch assembly 40. The zone 22 downstream from the rupture disc assembly 14 is extended into fluid communication with the switch assembly 40 via the passage 26, the pipe 30 mounting the housing structure 36 on the sleeve 28, the inlet 32 of the housing body member 34, and a passage 42 within the latter leading to a laterally enlarged upstream chamber 44 within the body member 34 that is in direct fluid communication with the upstream face of the switch assembly 40. The body member 38 of the housing structure 36 may be secured to the body member 34 in any suitable fashion, such as by crimping of a flange as at 46 of the body member 34 upon a cooperating surface of the body member 38. The body member 38 also contains a laterally enlarged chamber 48 facing and typically communicating with the downstream side of the switching assembly 40, as well as a passage 50 through which electrical lead wires 52 and 54 connected with the switch assembly 40 may emanate and extend to appropriate equipment for utilizing a change in the condition of closure of the electrical switch assembly 40 to provide a warning indication, to invoke protective control functions or for other purposes. In many applications, the downstream chamber 48 and passage 50 of the housing structure 36 will simply be in fully open fluid communication with the atmosphere, although in other applications it may be desirable to provide additional physical support for the downstream side of the switch assembly 40 by means of an electrical insulative filling or partial filling of hardened epoxy or similar material (not shown) within the downstream chamber 48 of the body member 38. By virtue of the high sensitivity of the switch assembly 40 to even relatively small increases in fluid pressure within the upstream chamber 44 with which it directly communicates, it is possible, when desired, and usually preferred for the specific application being considered for illustrative purposes, that some restricted fluid communication between the zone 22 and the atmosphere may be provided for the purpose previously noted by means of a small bleed port 56 from the passage 42 of the body member 34 to atmosphere, preferably through a larger threaded bore 58 (which may be conveniently plugged when such limited venting of the passage 42 and zone 22 is not desired).

In overall operation, the apparatus thus far described will be understood to function in essentially the following manner. As long as the rupture disc assembly 14 remains intact and there is no significant extent of leakage of fluid under pressure into the zone 22, the bleed port 56 will serve to maintain the zone 22 downstream from the rupture disc assembly 14 at or near the prevailing atmospheric pressure, including any ambient variations in barometric pressure. In such normal condition of the installation, the switch assembly 40 will remain unactuated and the potential electrical path therethrough will remain open, so that the associated utilization equipment, such as indicating lights on a remote monitoring panel (not shown), with which the lead wires 52 and 54 are connected will remain in inactive or "no fault" condition. Upon a fluid leak of any significant magnitude developing in or around the rupture disc assembly 14, however, the small bleed port 56 will not exhaust the leaking fluid to the atmosphere at a rate sufficient to prevent the fluid pressure within the zone 22, the passage 42 and the chamber 44 building up to at least some significant extent as such fluid accumulates therein. Since the switch assembly 40 may be designed to actuate in response to pressures upon its upstream side of as little as 1.0 psig (or even lower, if desired, a sensitivity to fluid pressure as small as about 1.0 inch of water having been achieved with experimental prototypes), the switch assembly 40 will be actuated to close as soon as the pressure within the chamber 44 reaches or exceeds the level for which the particular switch assembly 40 has been designed, thereby completing an electrical circuit between the lead wires 52 and 54, which may be utilized for operating a warning indicator light on a monitoring panel, actuating some other form of warning device or invoking some other electrically controlled function.

Referring next to FIGS. 3 and 4, more specific attention may be given to what is believed to be the most generally applicable, currently preferred embodiment of the construction of the improved, fluid pressure responsive electrical switching assembly 40 itself. The assembly 40, when fully fabricated and assembled, is in the nature of a laminated assembly in which the superposed elements constituting the layers thereof are marginally bonded together to form an essentially unitary structure having an internal fluid chamber 60 therewithin. Commencing from the downstream side of the switch assembly 40, the base contact subassembly 62 includes a disc-like baseplate 64 having a fixed electrical contact 66 secured to the upstream face thereof. Although not necessarily so configured, the baseplate 64 is preferably circular to conveniently fit within an annular cutaway portion 68 inside of the body member 38, and a marginal portion of the downstream face of the baseplate 64 is sealed and preferably bonded to the body member 38 in any suitable fashion by a sealant type bonding material as at 71. The baseplate 64 is formed of electrically insulative material and is of sufficient thickness, in the light of the material employed, to be relatively rigid. Since it is an object of the invention to accomplish miniaturization of the switch assembly 40, including minimizing the thickness thereof, however, the material to be used in forming the baseplate 64 is significant in order to provide the requisite degree of strength and rigidity with minimum thickness, as well as the other physical characteristics desired. Although the baseplate, and other electrically insulative portions of the assembly 40 hereinafter identified, could probably be formed of various plastic materials such as the "Mylar" or "Teflon" products marketed by E. I. DuPont de Nemours & Company of Wilmington, Del., or of other materials now commonly employed in the construction of printed circuit boards, the preferred material we use is known as "Kapton" polymide film, Type H, also marketed by the DuPont organization. Such Kapton plastic material is available in gauges or films of very small thickness and, even at thicknesses of the order of 0.001 inch, is characterized by high strength, good electrical insulating properties, good corrosion resistant properties, and good temperature stability capable of being employed throughout a temperature range as low as about −269° C. less and as high about +400° C. Such Kapton material also possesses the useful property that, with smaller thicknesses thereof, a film or plate thereof is relatively yieldable and resilient, while, with greater thicknesses thereof, a plate of such material is relatively unyielding and rigid to forces of the magnitudes that might be encountered by the switch assembly 40 in the typical types of applications for which its use is contemplated. The currently preferred thickness for the baseplate 64 is about 0.053 inch, although a lesser thickness thereof may be used if desired, particularly if downstream physical backing support for the baseplate 64 is to be provided within the chamber 48 to assure the requisite degree of strength of rigidity thereof.

The contact 66 is formed of electrically conductive metal, preferably copper, and may also be generally circular in configuration and of small, substantially uniform thickness preferably of the order of 0.001 inch or less. The contact 66 is secured to the upstream face of the baseplate 64 and is preferably fabricated by "cladding" directly upon the latter with subsequent etching or cutting away of undesired portions thereof, in the manner now commonly employed in the production of printed circuit boards and the like. The contact 66 is preferably of somewhat lesser diameter than the baseplate 64 to leave an exposed, outward margin 68 around the upstream face of the baseplate 64, both to avoid electrical connection between the contact 66 and the body member 38 of the housing structure 36 and to leave a peripheral area of the upstream face of the baseplate 64 to facilitate sealing and bonding of the baseplate 64 to the spacer layer 70 of the assembly 40 next to be described. Aligned holes as at 72 are provided through the baseplate 64 and preferably also the contact 66 to facilitate electrical connection of the lead wire 52 with the contact 66 in the manner subsequently described. Holes are also provided as at 74 through the baseplate 64 and any portion of the cladding layer for the contact 66 that may remain and be aligned therewith; however, since it will be understood that the lead wire 54 is to pass through the holes 74 for connection with another electrical contact of the switch assembly 40 yet to be identified, if the contact 66 would otherwise extend into adjacency with the holes 74, an annular or other appropriately shaped area 76 should be etched or cut away from the contact 66 around the holes 74 in order to electrically isolate the contact 66 from the lead wire 54. Those skilled in the art will appreciate from the nature of the remaining parts of the assembly 40 subsequently described that the contact 66 need not extend over as much as the upstream face of the baseplate 64 as illustrated in connection with the preferred embodiment depicted in the drawings, it being sufficient that the contact 66 extend over an inner or central portion of the upstream face of the baseplate 64 where it may be engaged by the other electrical contact of the assembly 40 and thence over a part of an intermediate portion of the upstream face of the baseplate 64 adjacent the holes 72 in order to facilitate electrical interconnection between the contact 66 and the lead wire 52; the illustrated configuration, however, is convenient and assists in assuring proper layering between the subassembly 62 and the spacer subassembly 70 next to be described.

The spacer subassembly 70 is preferably also fabricated of Kapton material and has a central aperture 78 spaced inward from its periphery to present an annular configuration of preferably the same outer diameter as the baseplate 64. The aperture 78 may conveniently be circular and, in the currently preferred construction, is disposed inwardly of the holes 72 and 74 of the baseplate 64 when the spacer 70 is in aligned, superposed relationship to the latter. The spacer 70 is also preferably provided with holes 80 and 82 arranged to respectively align with the holes 72 and 74 of the baseplate 64 when the switch 40 is assembled (although only the hole 82 or some other means of clearance through or around the spacer 70 for the wire 54 would be essential). The spacer 70 will typically be of a thickness of 0.005 inch or less (down to about 0.002 inch), the selected thickness being a design parameter that can be varied to control the operating characteristics of switches 40 intended for particular applications, it being noted that the diameter of the aperture 78 is also a selectable design parameter that will affect both the effective "working diameter" of the diaphragm subassembly 84 next to be described and the lateral dimension and extent of yieldability of the annular portion 83 of the spacer 70. Since the Kapton material of which the spacer 70 is preferably formed is resiliently yieldable in thicknesses thereof of the order involved, it will be apparent to those skilled in the art that such property of the spacer 70, along with the ability to preselect the thickness of the spacer 70 to be employed and the diameter of the aperture 78 thereof, provide a convenient set of design parameters that may be utilized in constructing switches 40 for particular applications, along with an internal fluid pressure parameter of the switch 40 that is also subject to design variation, as will hereinafter be further explained. The outer diameter of the spacer 70 (and, also, of the baseplate 64 and the diaphragm element 86 of the diaphragm contact subassembly 84 next to be described) will typically be less than 1.0 inch, say, about 0.91 inch, with the diameter of the aperture 78 of the spacer 70 typically being from about $\frac{1}{3}$ to $\frac{2}{3}$ of the outer diameter of the subassemblies 62, 70 and 84, depending upon the particular operating characteristics desired.

The diaphragm contact subassembly 84 includes a preferably circular, yieldable diaphragm element 86 having an electrical contact 88 secured to the downstream face thereof. The thickness of the diaphragm element 86 will typically be within the range of about 0.001 to 0.002 inch and should be relatively uniform throughout its lateral extent for consistency of the diaphragm action of the inward or central portion thereof which aligns with the aperture 78 of the spacer 70. Again, however, those skilled in the art will appreciate that the thickness of the diaphragm element 86 is a design parameter which may be varied within magnitudes of the general order mentioned, in order to provide switches 40 best suited for handling the levels of actuating pressure desired in particular applications of the apparatus 10. The contact 88 is secured directly to the diaphragm element 86 and may be fabricated as a thin copper layer or the like upon the diaphragm 86, in the general manner employed in manufacturing printed circuit boards, with the excess material then being etched away or otherwise removed to leave a contact 88 of the desired configuration. The diaphragm contact subassembly 84 is also preferably provided with holes 90 and 92 arranged to respectively align with the holes 80 and 82 in the spacer subassembly 70 and the holes 72 and 74 in the base contact subassembly 62. When such aligned holes are provided through all three of the subassemblies 62, 70 and 84, the assembly of the switch 40 is facilitated by permitting the lead wires 52 and 54 to be extended through all three of such subassemblies before effecting the required electrical connections internally of the switch assembly 40 as hereinafter described, although, as previously intimated in connection with the assemblies 62 and 70, those skilled in the art will appreciate that an alternate construction could be utilized employing only a hole 72 through the baseplate 64 (and, perhaps, through the base contact 66) and holes 74 and 82 through the base subassembly 62 and the spacer subassembly 70 (and, perhaps, the contact 88 of the diaphragm contact subassembly 84). The configuration of the diaphragm contact 88 carried by the diaphragm element 86 is not critical, but will preferably include a central portion aligned with the aperture 78 of the spacer subassembly 70 when the switch 40 is assembled and a lateral tab portion extending into adjacency with the aligned holes 74 and 82 (and 92 in the preferred construction) to facilitate electrical interconnection of the lead wire 54 with the contact 88.

As best seen in FIG. 4, the assembly of the previously described layers of the unit is accomplished by superposing the subassemblies 62, 70 and 84 and then bonding the same together to form a laminated structure. In the preferred construction of the switch 40, any suitable, electrically insulative bonding material is employed as at 94 between the outward marginal portion 68 of the upstream face of the baseplate 64 and the facing portion of the annular body 83 of the spacer subassembly 70, and also as at 96 between an outer marginal portion of the downstream face of the diaphragm element 86 and the facing portion of the spacer element of the subassembly 70. Such bonding material is then cured with heat or other appropriate means while the outward marginal portions of the subassemblies 62, 70 and 84 are being tightly pressed together, which effects not only the desired integration of the subassemblies 62, 70 and 84 into a unitary laminated structure, but also provides peripheral fluid seals extending around the chamber 60 within the aperture 78 of the spacer subassembly 70 and between the base contact subassembly 62 and the diaphragm contact subassembly 84. In the embodiment of the switch assembly 40 depicted in FIG. 4, such peripheral sealing renders the chamber 60 itself a sealed space within which fluid of desired pressure may be confined. The fluid pressure sealed within the chamber 60 during assembly of the switch 40 is, of course, another of the available design parameters that may be varied by those skilled in the art to control the level of fluid pressure required upon the external upstream face of the diaphragm subassembly 84 in order for the switch assembly 40 to respond or actuate to provide an engagement of the shiftable contact 88 carried by the diaphragm element 86 with the stationary contact 66 on the baseplate 64 to complete an electrical circuit therebetween. For many applications, it will be sufficient that the switch 40 be assembled in an atmosphere of air at ambient atmospheric pressure, which will thereby confine a body of air within the chamber 60 at that pressure; however, it should be apparent to those skilled in the art that either a gaseous fluid other than air may be confined and sealed within the chamber 60 by assembling the switch 40 in an atmosphere of such fluid, or the pressure of the fluid confined and sealed within the chamber 60 may be of preselected levels other than ambient atmospheric pressure, and either higher or lower than the latter, to adapt the switch 40 for responding to differentials of external fluid pressure relative to a reference pressure within chamber 60 other than the atmospheric pressure. It should be observed, however, that, when the switch assembly 40 is to be utilized in an application for responding to a relatively low external pressure within a typical range of about 1.0 to 15.0 psig, it has been found in practice that the particular actuation level desired can usually be most conveniently provided, while simply employing fluid confined at ambient atmospheric pressure within the chamber 60, through appropriate design variation of other of the variable parameters previously mentioned, such as the diameter of the aperture 78 or/and the thicknesses of the annular portion 86 of the spacer subassembly 70 and the diaphragm element 86 of the diaphragm contact subassembly 84.

The assembly of the switch 40 is completed by insertion of the conductive portions 98 and 100 of the lead wires 52 and 54 respectively through the corresponding aligned sets of holes 72, 80, 90 and 74, 82, 92, and then securing such conductive portions 98 and 100 therein by means of soldering or the introduction of other electrically conductive bonding material as at 102 and 104, which not only effects a filling and sealing of such holes, but also effects an electrical connection of the lead 52 with the fixed contact 66 and an electrical connection of the lead wire 54 with the diaphragm carried, shiftable contact 88, in the general manner in which electrical connections are made between metal cladded layers of printed circuit boards and lead wires introduced perpendicularly into holes in such boards. Where the switch assembly 40 is to be employed in an application involving temperatures above or below the normal ambient range, which is quite permissible, the particular material used for effecting the soldered or otherwise electrically conductive seals and connections as at 102 and 104 should, of course, be appropriately selected to accommodate to the thermal environment of the intended application.

Once the switch 40 is fully assembled, it may be emplaced within the body member 38 of the housing structure 36 and bonded and sealed therein as at 71, as previously mentioned. It is significant to note that the improved construction of the switch assembly 40, and particularly the manner in which electrical connections are effected between the lead wires 52 and 54 and the contacts 66 and 88 respectively, permit the lead wires 52 and 54 to emanate from the downstream face of the baseplate 64 and to thence simply pass through the bore 50 of the housing structure body 38, rather than presenting the mounting problems occasioned with switches whose electrical connections emanate from the side thereof or the problems that would exist if one or both of the connections were made on the upstream side of the switch assembly 40 which may be in a corrosive environment. In passing, it should also be observed that, although the housing structure 36 will typically be fabricated of metal, which is most convenient for most applications, such structure 36 could also be made from a suitable, rigid plastic material, if that should be necessary for some special environment of application involving unusual corrosive influences or the like.

FIG. 5 is intended to merely illustrate one more type of typical application for the pressure responsive electrical switching apparatus contemplated by the invention, and one in which there is no need, and it is not appropriate, to attempt to maintain the fluid pressure zone with which the apparatus is associated at atmospheric pressure. The enclosure 106 represents a dust collector bin into which dust laden air is being introduced under positive pressure through an inlet 108 and from which air may depart via an outlet 110 after the removal of dust therefrom within the bin 106. During operation, therefore, the interior zone 112 of the bin 106 will typically be at a fluid pressure other (and higher) than ambient atmospheric pressure. In such devices, one of the operational dangers involved is the possibility of dust explosions, which can be extremely damaging. It is known, however, that prior to the development of conditions which would cause or support an explosion of major proportions within the bin 106, there will typically be a series of preceeding, much smaller, or even minute, spontaneous disturbances each producing a relatively sharp pulse of increased fluid pressure within the zone 112. If such minute disturbances in equipment of this character can be detected and recognized as a forewarning of the possibility or likelihood of a subsequent larger explosion of more devastating power, appropriate steps may then be taken either automatically or manually in response to a warning signal to shut down the equipment or take other action to avert a major explosion before it has occurred. The improved pressure reponsive electrical switching apparatus of this invention provides a near ideal means for monitoring the zone 112 for the early detection of pulses of increased fluid pressure indicating the occurrence of the type of disturbances that normally preceed a major explosion in such environments, particularly since such switching apparatus, designated 10' in the drawings, is adapted to actuate in response to an increase in fluid pressure level of even a very small predetermined amount virtually immediately and typically within five milliseconds or less.

Referring also to FIG. 6 in conjunction with FIG. 5, it will be observed that the apparatus 10' is virtually identical to the apparatus 10 previously described, and like elements thereof are, therefore, identified by the same reference numerals. Indeed, the only difference in the structures depicted will be observed to be the absence in the housing structure 36' of the apparatus 10' of provision of a bleed port and cooperating bore as are provided at 56 and 58 in the housing structure 36 of the apparatus 10 earlier described for restrictedly communicating the zone 22 of the installation with the atmosphere. Thus, the switch assembly 40 may be designed for use in the apparatus 10' in a manner such that it will not actuate in response to a fluid pressure communicated to its passage zone 42 from the zone 112 of the bin 106 at the level of normal operating pressure within the latter, even though such pressure is above ambient atmospheric pressure, but rather will actuate only in response to a rise in fluid pressure level sufficiently above the normal operating pressure within the zone 112 to indicate the occurrence of the type of minute, "forerunner" disturbances to be detected in the equipment 106. Those skilled in the art will understand that, when a switch assembly 40 of the type previously described in connection with FIGS. 3 and 4 is employed in the apparatus 10', the pressure level upon the upstream, exterior face of the diaphragm 86 required to actuate the assembly 40 by internal shifting and engagement of the contact 88 with the contact 66 will be determined by appropriate design selection of the variable design parameters previously noted, including the diameter of the aperture 78, the thicknesses of the spacer portion 83 and the diaphragm 86, as well as the pressure of the fluid confined within the internal chamber 60 of the assembly 40. In such a construction, the baseplate 64 may be of a sufficient thickness to be substantially rigid and, if the apparatus 10' is to be used in an environment in which the prevailing level of fluid pressure upon the upstream face of the diaphragm 86 is relatively high, then epoxy fill material or the like can be employed within the chamber 48 for providing additional physical backup support for the baseplate 64.

Referring next to FIG. 7, there is illustrated a modified form of switch assembly 40', which it should be understood may be employed within a housing structure of either the type 36 used in the apparatus 10 or the type 36' used in the apparatus 10' or the type 36" hereinafter described. The modified switch assembly 40' may in all respects be identical in construction to that previously described for the assembly 40, except that, in the modified construction of the base contact subassembly 62' of the assembly 40', the baseplate 64' and the fixed contact 66' thereof are provided with an opening therethrough as at 114. Accordingly, in the switch assembly 40', the internal chamber 60' thereof is not a fully closed chamber, but rather communicates through the opening 114 with the housing chamber 48 and via the housing bore 50 with either the atmosphere or, as will next be described in connection with FIG. 8, with a zone containing fluid confined at some predetermined level typically different from ambient atmospheric pressure. In such modified embodiment of the switch assembly 40', when the opening 114 is in communication with the atmosphere through bore 50, it will be seen that the inner downstream side of the diaphragm contact assembly 84 is being subjected to the prevailing ambient atmospheric pressure, and that the actuation of the switch assembly 40' will then be responsive to the occurrence of a pressure differential on the opposite sides of the diaphragm contact assembly 84 of any level sufficient to cause the diaphragm 86 to yield in a downstream direction far enough to move the contact 88 thereon into engagement with the fixed contact 66'. This configuration is appropriate in applications where the fluid pressure to which the switch assembly 40' is to respond is desirably established in relationship to the inevitably changing level of ambient atmospheric pressure.

Another type of utilization of the modified switch assembly 40', which is illustrated in FIG. 8, employs a housing structure 36" in which the body parts 34 and 38 thereof may be the same as in the housing structure 36', but in which additional housing structure generally designated 116 is provided to present an overall modified form of the apparatus contemplated by the invention that is generally identified by the reference numeral 10". In the apparatus 10", the chamber 48 downstream from the baseplate 64' and which communicates with the internal chamber 60' through the opening 114 also further communicates through the bore 50 of the body 38 with a reference pressure zone or chamber 118 defined by additional housing body parts 120 and 122. The body part 120 is threadably mounted upon the body part 38 and sealed with the latter as by a gasket 124. The cap-like body part 122 is in turn threadably mounted upon the body part 120 and sealed therewith by a gasket, resilient O-ring or the like 126. The lead wires 52 and 54 extend from the baseplate 64' of the switch assembly 40' through the chamber 48, the bore 50, the zone or chamber 118 and out of the additional housing structure 116 through an opening 128 in the body member 122, without blocking fluid communication from the chamber 48 through the passage 50 to the chamber or zone 118. The opening 128 may, of course, be sealed in any suitable fashion as by a sealing grommet 130 and a soft sleeve 132 provided around the lead wires 52 and 54. It is most convenient in assembly, however, to also provide an intermediate structure 134 for facilitating the connection of the lead wires 52 and 54 via passthrough soldered connections as at 136 and 138, and it will be understood that, if a wafer 134 of Kapton or other fluid impervious material is utilized and appropriately sealed to the body part 122 of the additional housing structure 116 as by an O-ring 126 and the opposite pressure of the cap-like body part 122, such wafer 134 may itself serve as the downstream boundary for the chamber or zone 118, so that only physical protection for the lead wires 52 and 54 emanating from the cap 122 would be required, instead of actual fluid tight sealing. The body part 120 of the additional housing structure 116 is provided with a tap bore 140 into which is threaded a check valve assembly 142 through which fluid under pressure may be introduced from the outside into the chamber or zone 118 to any desired positive pressure level or, if desired, the chamber 118 may be evacuated to a predetermined desired level, the type of valve 142 to be employed preferably being selected in the light of whether the chamber 118 is to be maintained at a positive pressure or at some level of evacuation. After the fluid pressure within the chamber 118 has been established by external means at the desired level, a suitable closure cap 144 may be implaced upon the valve 142 to assure a long term seal.

As will readily be perceived, the modified apparatus 10" illustrated in FIG. 8 provides almost the ultimate in adaptability of the invention to the monitoring of widely varying fluid pressure conditions that may be encountered in different applications. Since the pressure differential level at which the apparatus 40' will be actuated in such embodiment is essentially determined between the zone 42 with which the upstream side of the diaphragm 86 communicates and the zone or chamber 118 in the additional housing structure 116, and since the latter may be set or adjusted to virtually any desired pressure level, the apparatus 10" may be utilized in diverse applications in which the normal prevailing pressure within the zone being monitored may be at virtually any level of pressure or vacuum likely to be encountered in environments wherein the type of monitoring for which the invention is intended would be appropriate. As those skilled in the art will appreciate, if the zone to be monitored should be at a very high, normal or prevailing pressure level, or at a substantial level of evacuation, such that the switch assembly 40' might otherwise be physically damaged during installation, the desired pressure level within the chamber 118 may be established at the installation site concurrently with placing the zone 42 of the housing assembly 36" into communication with the zone to be monitored in an appropriately controlled fashion to avoid excessive physical strain upon the switch assembly 40' during initial installation of the apparatus 10". By virtue of the high strength of the material out of which the assembly 40' is constructed, however, such considerations will typically not become germaine in most practical applications. In some installations it may be desirable to be able to change or adjust the fluid pressure level at which the apparatus 10″ is to be actuatable, which is, of course, readily permitted by the construction of the apparatus 10″ and its adaptability for increasing or decreasing the fluid pressure within the chamber 118 without even removing the apparatus 10″ from the installation which it is intended to monitor.

The versatility and other advantages of the improved pressure responsive electrical switching apparatus provided by the invention have been illustrated by example and should be clear to those skilled in the art from the preferred embodiments of the invention shown and described. It will be equally apparent to those skilled in the art, however, that various minor modifications or adaptations of the apparatus could be made within the spirit of the invention and without departing from the essence of the improvement it accomplishes over prior devices heretofore available for some of the same general purposes. Accordingly, it is to be understood that the invention should be deemed limited only by the fair scope of the claims which follow, including mechanical equivalents of the subject matter referred to therein.

We claim:

1. In fluid pressure responsive electrical switching apparatus having a laminated switch assembly including a diaphragm contact subassembly at one extremity of said assembly and having an upstream face adapted to communicate directly with fluid in a zone to whose pressure said apparatus is to respond and an opposite downstream face, an intermediate spacer subassembly provided with a laterally inwardly aperture therethrough and having an upstream surface extending around one extremity of said aperture and engaged with said downstream face of said diaphragm contact subassembly and an opposite downstream surface extending around the opposite extremity of said aperture, a base contact subassembly at the opposite extremity of said assembly and having an upstream face of which a portion is engaged with said downstream surface of said spacer assembly and an opposite downstream face, and means for securing said subassemblies together in the aforesaid relationship thereof, said diaphragm contact subassembly comprising a relatively yieldable, electrically insulative diaphragm element having an upstream surface presenting said upstream face of said diaphragm contact subassembly and an opposite downstream surface facing said upstream surface and said one extremity of said aperture of said spacer subassembly, and electrically conductive, first contact structure secured to said downstream surface of said diaphragm element and extending over at least a portion of the latter aligned with said aperture of said spacer subassembly, said spacer subassembly comprising an electrically insulative spacer element having said aperture therethrough, said base contact subassembly comprising a relatively rigid, electrically insulative baseplate element having an upstream surface facing said downstream surface and said opposite extremity of said aperture of said spacer subassembly and an opposite downstream surface, and electrically conductive, second contact structure secured to said upstream surface of said baseplate element and extending over at least a portion of the latter aligned with said aperture of said spacer subassembly and with at least a part of said first contact structure, said first and second contact structures being normally spaced apart when said diaphragm element is in a normal disposition thereof, said part of said first contact structure being shiftable into engagement with a part of said second contact structure through said aperture when a portion of said diaphragm element aligned with said aperture moves sufficiently in a downstream direction under the influence of a fluid pressure of at least a predetermined level applied to said upstream face of said diaphragm contact subassembly, there being a fluid chamber in said assembly within said aperture of said spacer subassembly and between said downstream face of said diaphragm contact subassembly and said upstream face of said base contact subassembly, there being housing means for mounting said switch assembly with said upstream face of said diaphragm contact subassembly in direct fluid communication with said zone, there being means for peripherally sealing said switch assembly to said housing means to separate said upstream face of said diaphragm contact subassembly from direct fluid communication with said downstream face of said base contact subassembly, there being electrically conductive lead means for effecting electrical connection with at least one of said contact structures internally of said switch assembly, said lead means passing through said baseplate element and emanating from said downstream surface thereof, the improvement of which comprises:

each of said diaphragm element, said spacer element and said baseplate element being provided with a pair of holes therethrough, one of said pair of holes through each of said elements being aligned with each other, the other of said pair of holes through each of said elements being aligned with each other, a portion of said first contact structure extending into adjacency with said one hole through said diaphragm element, a portion of said second contact structure extending into adjacency with said other hole through said baseplate element, and said lead means including a first lead wire extending through said one holes and said first contact structure and being electrically connected with the latter, and a second lead wire extending through said other holes and said second contact structure and being electrically connected with the latter.

2. Apparatus as set forth in claim 1, wherein:

said chamber is sealed and contains a fixed quantity of fluid therein.

3. Apparatus as set forth in claim 1, wherein:

there is provided an opening through said baseplate element placing said chamber in fluid communication with a space downstream of said base contact subassembly, said space is in fluid communication with the atmosphere, whereby said chamber will be maintained at ambient atmospheric pressure.

4. Apparatus as set forth in claim 1, wherein:

there is provided an opening through said baseplate element placing said chamber in fluid communication with a space downstream of said base contact subassembly, said housing means includes portions for enclosing said space, and means for confining fluid within said space at a predetermined pressure level, whereby said chamber will be maintained substantially at said predetermined pressure level.

5. Apparatus as set forth in claim 1, wherein:

said housing means is provided with a fluid flow restricting bleed port oppositely in fluid communication with said upstream face of said diaphragm contact subassembly and the atmosphere.

6. Apparatus as set forth in claim 1, wherein:

said diaphragm element is a relatively thin disc of polymide plastic film material of substantially uniform thickness, said baseplate element is a relatively thicker disc of polymide plastic film material of substantially uniform thickness, said first and second contact structures are layers of metal material of substantially uniform thickness respectively adhered to said downstream surface of said diaphragm element and said upstream surface of said baseplate element, said spacer element is a generally annular body of a polymide plastic film material of substantially uniform thickness intermediate the thicknesses of said diaphragm element and said baseplate element.

* * * * *